United States Patent [19]

Krehbiel

[11] 4,306,744

[45] Dec. 22, 1981

[54] DOOR RETAINER AND ALARM DEVICE

[76] Inventor: V. Dwight Krehbiel, 125 S. Pershing, Wichita, Kans. 67218

[21] Appl. No.: 99,220

[22] Filed: Dec. 3, 1979

[51] Int. Cl.[3] ..... E05B 47/00

[52] U.S. Cl. ..... 292/144

[58] Field of Search ..... 292/144, 251.5, 244, 292/74

[56] References Cited

U.S. PATENT DOCUMENTS

| | | | |
|---|---|---|---|
| 2,497,697 | 2/1950 | Smith | 292/144 X |
| 2,586,900 | 2/1952 | Alderman | 292/74 |
| 2,786,701 | 3/1957 | Povlich | 292/144 |
| 3,426,166 | 2/1969 | Canceill | 292/251.5 X |
| 3,431,002 | 3/1969 | Melgaard | 292/251.5 |
| 3,751,086 | 8/1973 | Geringer | 292/144 |
| 4,155,576 | 5/1979 | Kennon | 292/251.5 |

*Primary Examiner*—Richard E. Moore

*Attorney, Agent, or Firm*—Edwin H. Crabtree

[57] ABSTRACT

A door retainer and alarm device for retaining a swinging door in a closed position in a door frame and actuating an alarm. The retainer includes an electrical switch which may be wired to an alarm so that when the door is opened without authorization the alarm is actuated. The retainer automatically holds the door in a closed position in the door frame.

8 Claims, 8 Drawing Figures

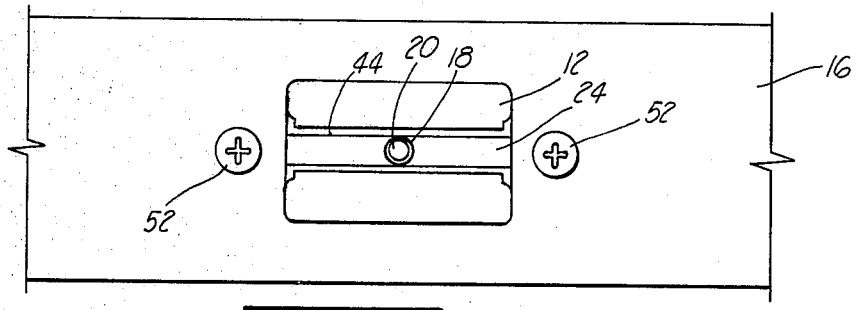
FIG. 4
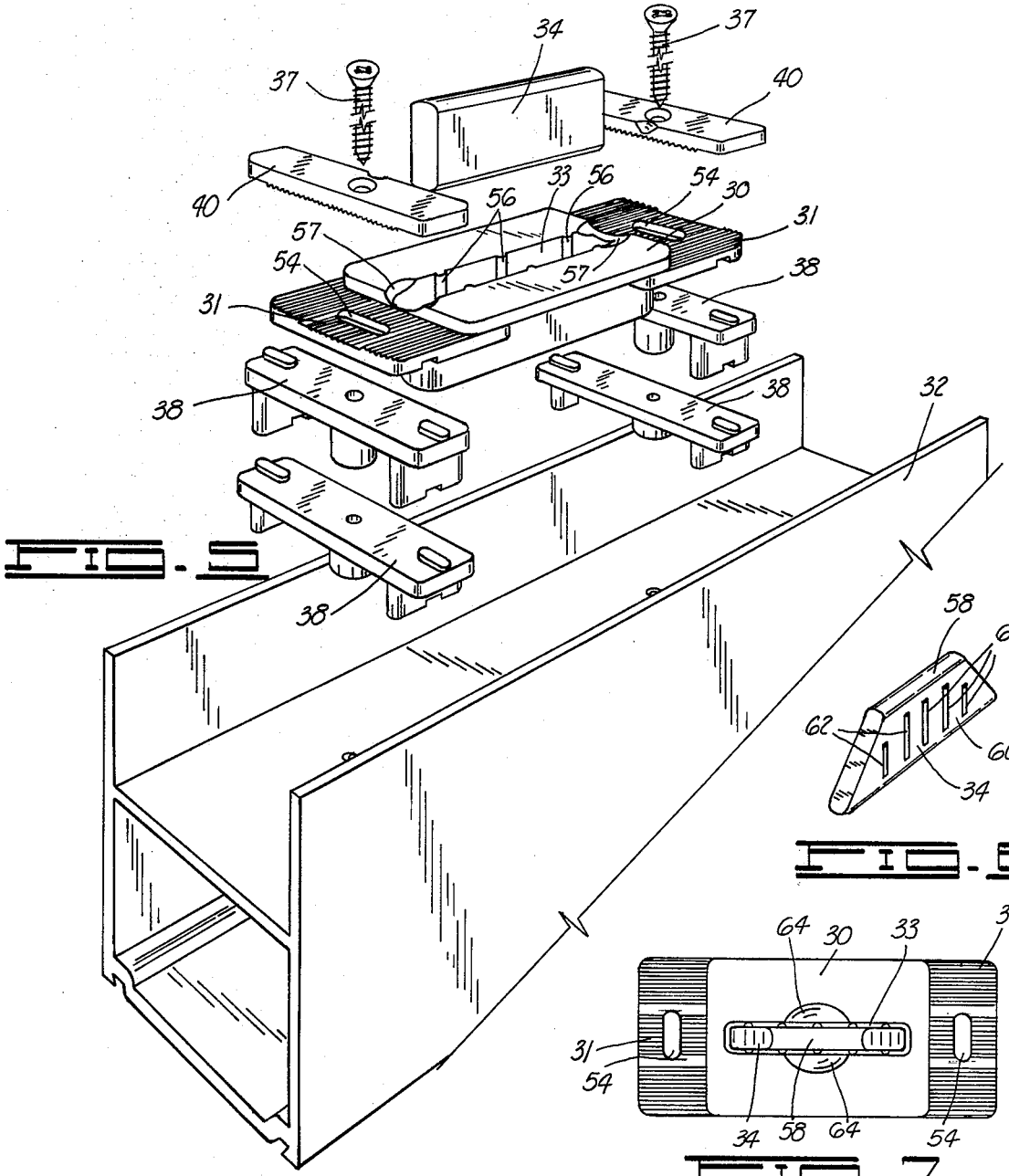
FIG. 5
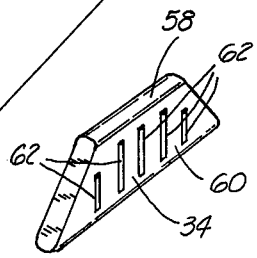
FIG. 6
FIG. 7

DOOR RETAINER AND ALARM DEVICE

BACKGROUND OF THE INVENTION

This invention relates generally to a door retainer and alarm device and more particularly, but not by way of limitation, to a magnetic door retainer for holding a one-way or two-way swinging door in a closed position in a door frame. The device actuating an alarm when the door is opened without authorization. Heretofore, there have been various types of magnetic catches and door latches as disclosed in U.S. Pat. Nos. 2,719,050 and 2,853,331 to Teetor and 2,586,900 to Alderman. Also there are prior art magnetic door stops and magnetic touch latches described in U.S. Pat. Nos. 2,497,697 to Smith, 3,258,285 to Smith and 3,492,031 to Hutchison.

More recently a patent application Ser. No. 906,086 filed by Ronald L. Biggs and licensed by the applicant disclosed a door stay retainer having means for adjusting the depth of a groove for receiving a metal retainer bar attracted by a magnet mounted in a magnet housing in the door frame. By adjusting the depth of the groove, the force is regulated which is required for opening the swinging door in the door frame.

None of the prior art patents or the above-mentioned patent application disclose the unique structure and advantages of the improved door retainer and alarm device as described herein.

SUMMARY OF THE INVENTION

The subject invention retains a one-way and two-way swinging door in a closed position in a door frame. The door prevents the loss of heat in winter and the loss of air conditioning in the summer due to wind gusts opening the door. The invention is simple in design, and is concealed in the door and door frame and cannot be seen when the door is in a closed position.

The door retainer is adapted for actuating an electrical switch wired to an alarm so that the alarm is sounded when the door is opened without authorization.

The retainer is characterized by being adapted for installation in new doors, doors that are already in operation and it may be used in various sizes, types and designs of doors. The retainer may be adjusted upwardly and downwardly in the door and laterally across the width of the door so that it may be properly aligned with a magnet housing mounted in the door frame.

The retainer includes a metal retainer bar which is angular in shape having a bottom portion with a greater surface area than a top portion. The retainer bar is slidably received in a channel in a metal retainer bar housing. By reversing the bar in the channel, the different surface areas are exposed to the attraction of the magnet in the magnet housing so that the degree of force required in opening the door from the door frame can be adjusted. Also, the sides of a groove in the magnet housing are beveled so that the bar is more easily released from the groove when the door is opened from the door frame.

The door retainer and alarm device includes a magnet mounted in a magnet housing. The housing is adapted for receipt in the door frame. A retainer bar groove is disposed in the magnet housing and adjacent the door when the door is in a closed position in the door frame. A retainer bar housing is adapted for receipt in the door and includes an elongated channel therein for receiving a metal retainer bar. The metal retainer bar housing is adjustable upwardly and downwardly in the door and may be adjusted laterally across the width of the door so that the elongated channel is disposed adjacent the groove in the magnet housing for proper alignment. The bar is slidably mounted in the channel with the top portion and bottom portion of the bar dimensioned for receipt in the groove. When the swinging door is in a closed position in the door frame, the bar is indexed adjacent the groove in the magnet housing. The magnet urges the bar upwardly with the top portion or bottom portion of the bar received in the groove for retaining the door in a closed position in the door frame. An electrical switch is mounted on top of the magnet housing and is actuated by the bar when it is received in the groove. An alarm is wired to the switch and is actuated when the door is opened without authorization.

The advantages and objects of the invention will become evident in the following detailed description when read in conjunction with the accompanying drawings which illustrate the preferred embodiments of the invention.

BRIEF DESCRIPTION OF THE DRAWINGS

FIG. 4 is a top view of the magnet housing mounted in the door frame.

FIG. 5 is an exploded view of the retainer bar housing and retainer bar with interlocking door spacers and lateral adjustment plates which are used for mounting the housing in the top of a metal door.

FIG. 6 illustrates an alternate embodiment of the retainer bar.

FIG. 7 illustrates a top view of the metal retainer bar shown in FIG. 6, slidably received in the elongated channel of the retainer bar housing.

DETAILED DESCRIPTION OF THE DRAWINGS

Figure 1:
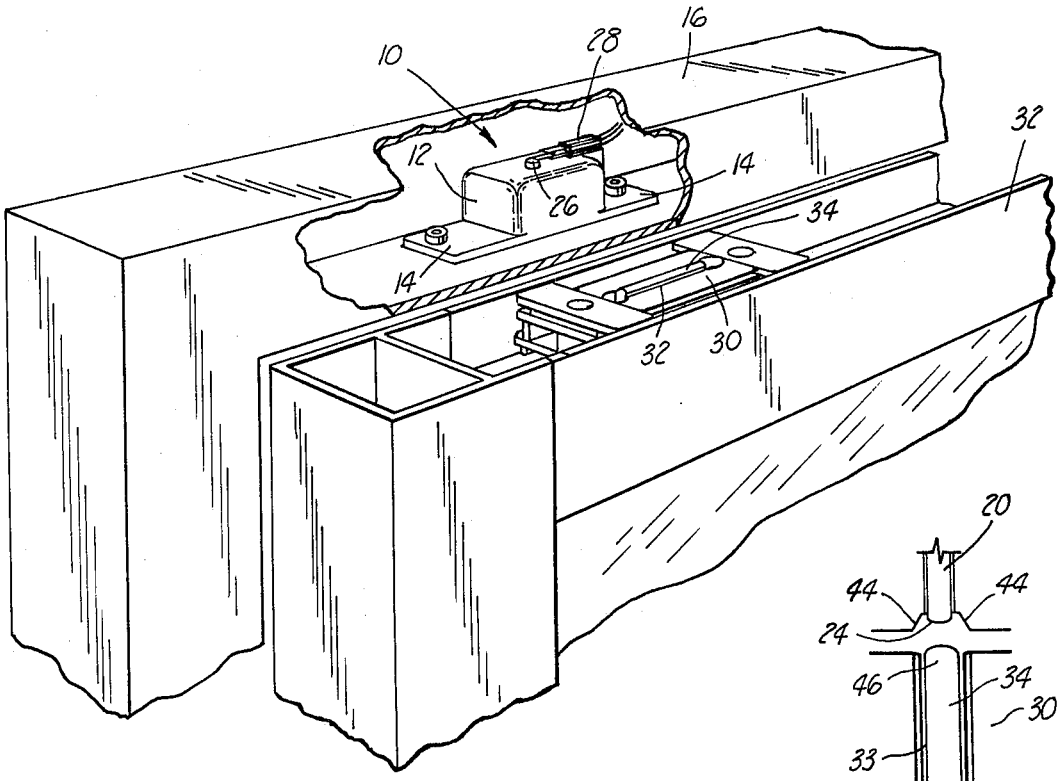
FIG. 1 is a perspective view of the door retainer and alarm device mounted in a door frame and a door.

In FIG. 1, the door retainer and alarm device are designated by general reference numeral 10. The device 10 includes a magnet which is not shown in the drawings but is enclosed in a magnet housing 12 having outwardly extending ears 14 which are used for mounting the housing 12 to a door frame 16. An aperture 18 is disposed through the center of the housing 12 for receiving a switch pin 20 therethrough. A lower end portion 22 of the pin 20 is received in a beveled retainer bar groove 24 which extends along the length of the bottom of the magnet housing 12. An upper end 26 of the pin 20 is disposed adjacent an electrical switch 28 which is attached to the top of the housing 12. The pin 20 and switch 28 can be seen more clearly in the sectional views of FIGS. 2 and 3.

The door retainer 10 further includes a retainer bar housing 30 having outwardly extending ears 31. The housing 30 is adjustably mounted in the top of a door 32. The door 32 may be made of wood, lightweight metal or any other type of material used in door and door frame construction. In the drawings of this application, the door 32 and door frame 16 are shown made of a extruded metal channel construction.

The retainer bar housing 30 includes an elongated channel 33 for receiving a metal retainer bar 34. The metal retainer bar 34 may be of various configurations but is generally angular in shape with the width of the bar 34 less than the width of the channel 33 so that the bar 34 can be easily raised and lowered in the channel 33. The ears 31 extending outwardly from both ends of the housing 30 are attached by screws 37 to interlocking spacers 38 and lateral adjustment plates 40. The plates 40 have serrations which match serrations in the top of the ears 36 so that the housing 30 may be adjusted laterally in the door 32. The spacers 38 allow the depth of housing 30 to be adjusted inside the door 32.

Figure 2A:
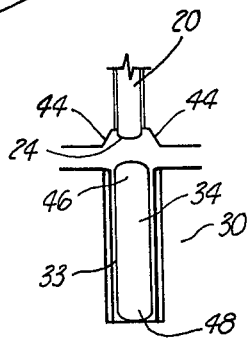
FIG. 2A is an enlarged view of part of FIG. 2.
Figure 2:
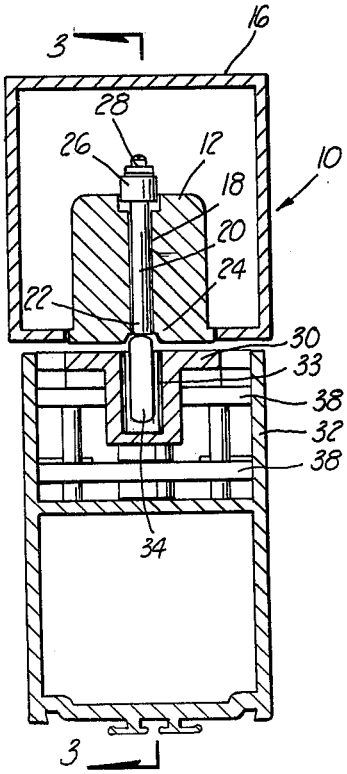
FIG. 2 is a side sectional view of the retainer mounted in the door and door frame.

In FIG. 2, a side sectional view of the device 10 can be seen in the door frame 16 and door 32 with the device 19 activated by the retainer bar 34 slidably received in the beveled groove 24 of the magnet housing 12. When the bar 34 is urged upwardly by the magnetic attraction of the magnet in the housing 12. A top portion of the bar 34 is slidably received in the groove 22 and contacts the lower end 22 of the pin 20 thereby urging the pin 20 upwardly with the top portion 26 of the pin closing the normally opened switch 28. The switch 28 may be wired to any type of visual or audio alarm for alerting an owner of the building that the switch 28 is actuated and if the door 32 is opened without authorization then the bar 34 will be released from the groove 24 and slide downwardly into the channel 34 shown in the enlarged view to the left of FIG. 2. In this view, the bar 34 has been released from the groove 24 and the switch 28 has moved downwardly thereby opening the switch 28. It can be appreciated that the switch 28 can be wired in both an open or closed position for actuating an alarm when the door 32 is opened.

Also seen in the enlarged view which is part of FIG. 2, are beveled sides 44 along the length of the groove 24. It should be noted by beveling the sides 44 of the groove 24 and rounding off a top portion 46 and a bottom portion 48 of the bar 34, the bar 34 can more easily be received and released from the groove 24 when it is magnetically attracted to the magnet in the housing 12.

Figure 3:
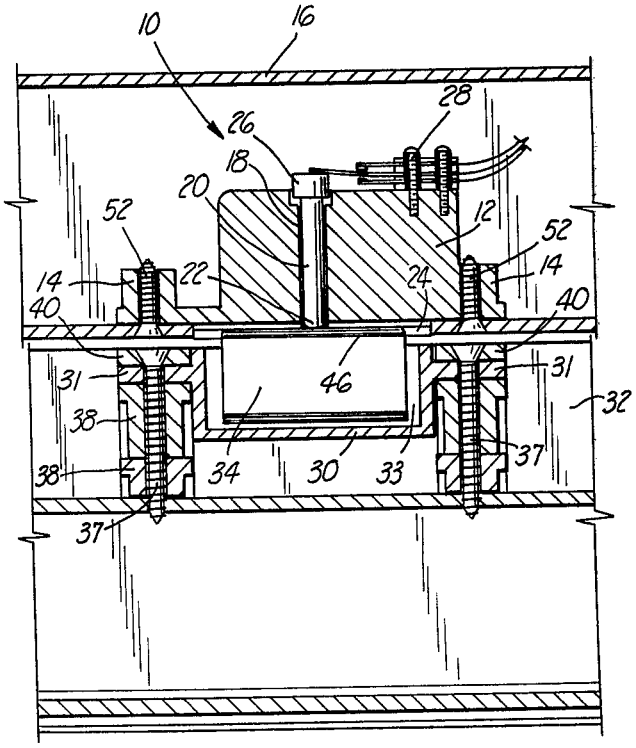
FIG. 3 is a front sectional view of the retainer mounted in the door and door frame.

In FIG. 3 a side sectional view of the device 10 is shown with the bar 34 in a raised position in the channel 33 with the top portion 46 of the bar received in the groove 24 thereby raising the pin 26 in the aperture 18 with the top end 26 of the pin 22 closing the switch 28 for actuating the alarm. The wiring is shown in FIG. 3 but not the alarm. Also seen in this view is a side elevational view of the spacers 38 on both sides of the bar housing 30 having apertures therethrough for receiving the pair of screws 37 which secure the plates 40, ears 31 and interlocking spacers 38 to the door 32. It can be appreciated, depending on the type of door 32, any number of spacers 38 may be used so that the retainer bar housing 30 can be properly adjusted so that the top of the housing 30 and plates 40 are flush with the top of the door 32 and the elongated channel 33 is parallel to the groove 24 in the magnetic housing 12.

In FIG. 4 a top view of the magnetic housing 12 can be seen attached to the door frame 16 by a pair of screws 52. Also seen in this view is the elongated groove 24 with beveled sides 44 with the aperture 18 centered in the groove 24 with the switch pin 20 extending therethrough.

In FIG. 5 an exploded view of the retainer bar housing 32 and magnetic retainer bar 34 are shown in position for receipt in the top of the extruded channel of the door 32. In this view, the plates 40 can be seen with serration in the bottom thereof for mating against the top of serrations in the ears 31 of the retainer bar housing 30. The ears 31 also include elongated openings 54 so that when the screws 37 are received therethrough, the ears 31 along with the housing 30 can be properly adjusted laterally across the width of the door 32 and on top of the spacers 38 so that the elongated channel 33 can be properly aligned and parallel to the groove 24 of the magnetic housing 12. Also seen in this view are the interlocking spacers 38 for adjusting the retainer bar housing 30 to a proper depth in the top of the door 32.

Also seen in this view are outwardly extending channel ribs 56 along the opposite sides of the channel 33. These ribs 56 contact the sides of the retainer bar 34 to reduce the sliding friction between the sides of the channel 33 and the side of the bar 34 as the bar 34 is raised and lowered for receipt in the groove 24 of the magnet housing 12. At the ends of the channel 33 and in the top of the housing 30 are indents 57 which are used for ease in gripping the bar 34 with the fingers to remove or reverse the bar 34 in the channel 33.

In FIG. 6 an alternate embodiment of the retainer bar 34 is illustrated having a top portion 58 which has a surface area which is less than a bottom portion 60 of the bar 34. From reviewing this drawing it can be seen that the bar 12 is dimensioned so that it is reversible in the channel 33. If it is desired that less force be required in opening the door 32 in the frame 16, then the top portion 58 of the bar 34 will be used for receipt in the groove 24. If more force is desired in retaining the door 32 in the frame 16, then the bar 34 will be removed and turned upside down so that the greater surface area of the bottom portion 60 of the bar 34 is received in the groove 24 thereby requiring greater force to release the bar 34 from the magnetic attraction of the magnet in the housing 12.

The bar 34 in FIG. 6 also includes outwardly extending vertical ribs 62 on opposite sides of the bar 34 which are used to reduce sliding friction inside the channel 33 when the ribs 56 are not formed in the channel 33. The bar 34 may also be chrome or electro-film plated to reduce friction when in use in the device 10.

In FIG. 7 a top view of the retainer bar housing 30 is illustrated with an indent 64 disposed in the center of the housing 30 and on opposite sides of the channel 33. In this view the bar 34 shown in FIG. 6 is received in the channel 33 with the top portion 58 extending upwardly in the channel 33. Through the use of the indents 64, the operator of the door 32 using his fingers can quickly remove the bar 34 and turn the bar 34 upside down so that the bottom portion 60 is received in the top of the channel 33 so that a greater surface area is received in the groove 24 when the door 32 is closed. As mentioned above, the bar 34 would be used in this manner when a greater force is desired for opening the door 32 in the frame 16.

Changes may be made in the construction and arrangement of the parts or elements of the embodiments as described herein without departing from the spirit or scope of the invention defined in the following claims.

I claim:

1. A door retainer and alarm device for retaining a swinging door in a closed position in a door frame and actuating an alarm, the retainer comprising:

a magnet mounted in a magnet housing, the housing adapted for receipt in the door frame to be attached thereto;

a retainer bar groove disposed in the magnet housing and adjacent the door when the door is in a closed position in the door frame;

a retainer bar housing adapted for receipt in the door to be attached thereto, the retainer bar housing having an elongated channel therein;

a metal retainer bar slidably received in the channel, a top portion of the bar dimensioned for receipt in the groove; and electrical switch means for actuating the alarm, the switch means attached to the magnet housing and actuated by the bar when the bar is received in the groove in the magnet housing.

2. The retainer as described in claim 1, wherein the switch means includes a switch pin slidably received in an aperture through the magnet housing, the lower end of the pin received in the groove, the upper end of the pin disposed adjacent a switch mounted on top of the magnet housing, when the bar is received in the groove, the pin is urged upwardly in the aperture with the upper end of the pin contacting the switch and actuating the alarm.

3. The retainer as described in claim 1, wherein the sides of the groove are beveled so that the bar is more easily released from the sides of the groove when the door is opened in the door frame.

4. The retainer as described in claim 1, wherein the bar is angular in shape with the top portion and the bottom portion of the bar reversible in the channel, the bottom portion of the bar dimensioned to have a greater surface area than the top portion of the bar.

5. The retainer as described in claim 4, wherein the top of the bar housing has indents therein and disposed adjacent the sides of the channel so that the bar can be gripped with the fingers when it is desired to reverse the bar in the channel or remove the bar from the channel.

6. The retainer as described in claim 1, wherein the sides of the channel include channel ribs extending outwardly on opposite sides of the channel, the bar sliding on top of the channel's ribs upwardly and downwardly as the bar is attracted magnetically to the magnet in the magnet housing.

7. The retainer as described in claim 1, wherein the metal retainer bar includes bar ribs extending outwardly from the sides of the bar, the bar ribs sliding along the sides of the channel in the bar housing as the bar is raised and lowered in the channel when attracted magnetically to the magnet in the magnet housing.

8. A magnetic door stay retainer and alarm device for retaining a swinging door in a closed position in a door frame and actuating an alarm, the retainer comprising:

a magnet mounted in a magnet housing, the housing adapted for receipt in the door frame to be attached thereto, the housing having an aperture extending therethrough;

a retainer bar groove disposed in the magnet housing and adjacent the door when the door is in a closed position in the door frame;

a retainer bar housing adapted for receipt in the door to be attached thereto, the retainer bar housing having an elongated channel therein;

a metal retainer bar slidably received in the channel, a top portion of the bar dimensioned for receipt in the groove; and a switch pin slidably received in the aperture through the magnet housing, the lower end of the pin received in the groove, the upper end disposed adjacent a switch mounted on top of the magnet housing, the switch wired to the alarm;

when the swinging door is in a closed position in the door frame, the bar is indexed adjacent the groove in the magnet housing, the bar is urged magnetically toward the magnet and the top portion of the bar is received in the groove for retaining the door in a closed position in the door frame, the top portion of the bar also urging the pin upwardly in the aperture with the upper end of the pin contacting the switch and actuating the alarm.

* * * * *